United States Patent [19]

Schewe

[11] 3,977,168

[45] Aug. 31, 1976

[54] MODULAR OPEN END SPINNING MACHINE

[75] Inventor: Richard A. Schewe, Rockford, Ill.

[73] Assignee: Barber-Colman Company, Rockford, Ill.

[22] Filed: June 11, 1975

[21] Appl. No.: 585,968

[52] U.S. Cl. ..... 57/1 R; 57/34 R; 57/58.89

[51] Int. Cl.[2] ..... D01H 11/00; D01H 1/12

[58] Field of Search ..... 57/1 R, 34 R, 58.89–58.95

[56] References Cited

UNITED STATES PATENTS

| | | | |
|---|---|---|---|
| 3,103,095 | 9/1963 | Keyser | 57/1 R |
| 3,381,458 | 5/1968 | Rajnoha et al. | 57/1 R |
| 3,511,045 | 5/1970 | Bures et al. | 57/58.95 X |
| 3,627,584 | 12/1971 | Stewart | 57/58.89 X |
| 3,774,382 | 11/1973 | Bartling | 57/1 R |
| 3,782,095 | 1/1974 | Bures et al. | 57/1 R X |
| 3,810,352 | 5/1974 | Miyazaki et al. | 57/34 R |

*Primary Examiner*—Donald E. Watkins
*Attorney, Agent, or Firm*—A. Richard Koch

[57] ABSTRACT

An open end spinning machine is assembled from intermediate modular sections connected together in end-to-end alignment between end sections. The construction of the modular sections used in the machine is disclosed.

31 Claims, 4 Drawing Figures

MODULAR OPEN END SPINNING MACHINE

BACKGROUND OF THE INVENTION

This invention relates to machines for spinning textile fibers by the open end method, whereby fibers are fed into a cavity of a spinning rotor, where they are spun into thread. A typical open end spinning unit is described in U.S. Pat. No. 3,807,157, issued Apr. 30, 1974 to Fritz Stahlecker. More particularly this invention relates to a modular construction of an open end spinning machine comprising a plurality of spinning stations, each of which spins fibers into thread and winds the thread on a package. Maintaining proper alignment of the modular sections and the components within the modular sections has been a problem in the past.

SUMMARY OF THE INVENTION

A rigid backbone in each modular section supports all other components of the modular section in fixed operative relation to each other. When the backbones are rigidly connected in end-to-end alignment, drive shafts, vacuum ducts, channels and the like supported by one backbone are automatically positioned to permit them to be operatively coupled to respective drive shafts, vacuum ducts, channels and the like supported by an adjacent backbone.

DESCRIPTION OF THE PREFERRED EMBODIMENT

Figure 1:
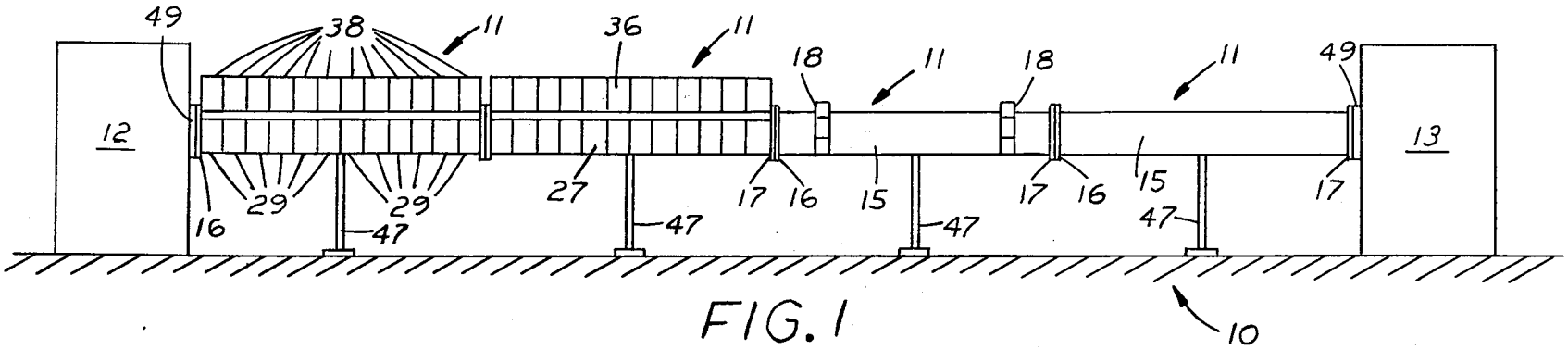
FIG. 1 is a longitudinal elevation of one embodiment of an open end spinning machine according to this invention, said machine having components broken away to demonstrate construction.

In a preferred embodiment of this invention shown in the drawings, an open end spinning machine 10 comprises a plurality of intermediate modular sections 11 in end-to-end aligned relation between end sections 12, 13, as shown in FIG. 1.

Figure 2:
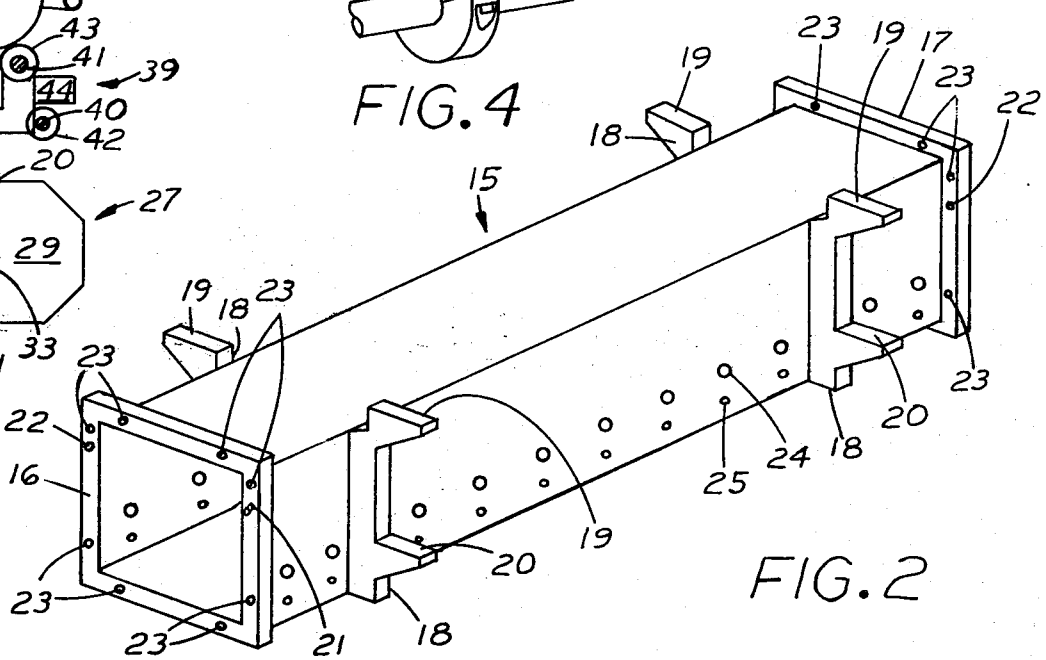
FIG. 2 is a perspective view of a backbone employed in the embodiment shown in FIG. 1.
Figure 3:
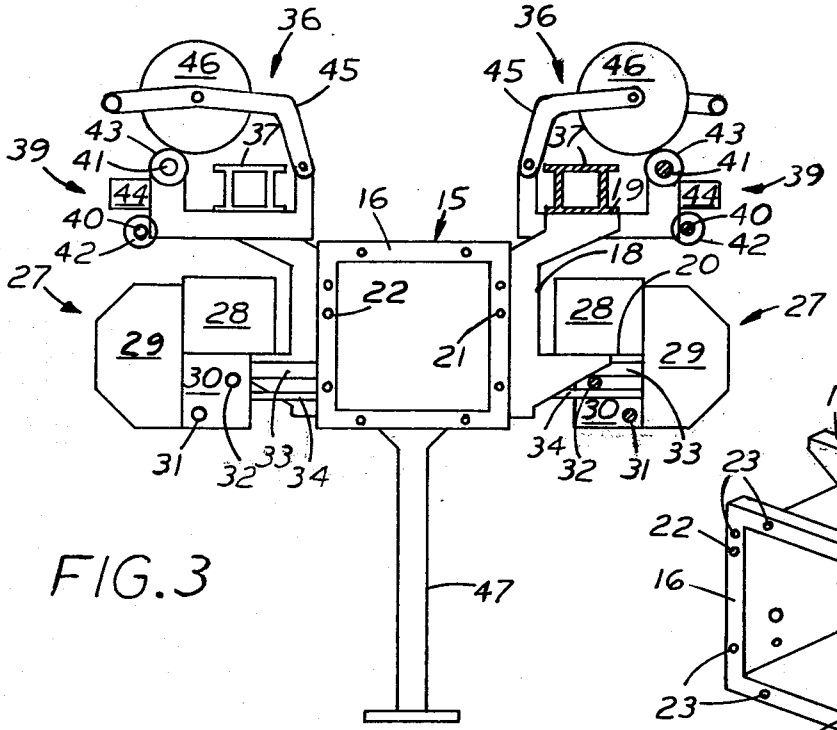
FIG. 3 is an end view of one of the intermediate modular sections assembled on the backbone.

Each modular section 11 comprises an elongated rigid tubular backbone 15 with flat flanges 16, 17 perpendicular to the longitudinal axis of the backbone at the ends thereof and a plurality of brackets 18 affixed in accurately predetermined positions on opposite sides thereof, as best seen in FIG. 2. Each bracket has upper and lower supporting surfaces 19 and 20 respectively. The flanges 16, 17 are flat and perpendicular to the longitudinal axis of the backbone 15 so that, when the flanges of adjacent end-to-end backbones are connected together, the end-to-end backbones will be in substantially perfect longitudinal alignment. Locating pins 21 in at least one of the flanges 16, 17 are snugly received in correspondingly located receiving holes 22 in the other of the flanges 16, 17 of the adjacent backbone 15 to assure accurate lateral alignment of the backbone. Clearance holes 23 in corresponding positions on the flanges 16, 17 receive bolts to fasten adjacent flanges rigidly together and thus connect the aligned backbones 15 into a rigid structure between the end sections 12, 13. Two holes 24, 25 for each spinning unit to be supported on the backbone are provided in the sides of the tubular backbone for purposes to be explained later.

Spinning bays or sub-assemblies 27 are supported by and bolted to the lower supporting surfaces 20 on opposite sides of the backbone 15. Each spinning sub-assembly comprises an elongated rigid support, shown as a channel box 28, housing apparatus, such as is shown and described in Stahlecker U.S. Pat. No. 3,779,620 issued on Dec. 18, 1973, for driving spinning rotors (not shown) in a plurality of open end spinning units 29 mounted at predetermined spaced spinning stations on the channel box. The spinning units may be of the type shown and described in my copending patent application Ser. No. 586,880, filed on June 13, 1975. The channel box 28 is usually the same length as the backbone 15 and is the portion of the spinning sub-assembly 27 resting upon and bolted to the supporting surfaces 20. A driving mechanism 30, comprising feed and opening drive shafts 31, 32 respectively delivering power through appropriate mechanism to feed and opening rolls (not shown) in the spinning unit 29, is joined to the channel box 28. The spinning chamber (not shown) in the spinning unit 29 is connected by a tube 33 to a duct drawing air from the spinning chamber to provide a partial vacuum therein. In this embodiment the tubular backbone 15 doubles as the duct with tube 33 connected to it through hole 24. A second tube 34 connects the cleaning chamber (not shown) in spinning unit 29 to a duct drawing air and trash by a partial vacuum from the cleaning chamber. In this embodiment the tubular backbone 15 also serves as the second duct with tube 34 connected to it through hole 25. The employment of a single duct to produce both partial vacuums is made possible by the teachings of my aforesaid copending application Ser. No. 578,352, filed on May 16, 1975. The shafts 31, 32 and the ducts (if separate ducts are employed) in the spinning sub-assemblies 27 must be substantially the same length as and coextensive with the backbone 15 upon which the sub-assemblies are mounted.

Winding bays or sub-assemblies 36 are supported by and bolted to the upper supporting surfaces 19 on opposite sides of the backbone 15. Each winding sub-assembly comprises an elongated rigid support, shown as a beam 37, upon which is mounted a plurality of winding units 38, equal in number to and aligned with the spinning units 29 mounted on the channel box 28. Driving apparatus 39, comprising withdrawal and package drive shafts 40, 41 respectively delivering power to withdrawal rolls 42 and to package drive rolls 43 and traversing mechanism 44, is connected to the beam 37. The drive shafts 41, 42 are of substantially the same length as the backbone 15. There is a withdrawal roll 42, a traverse mechanism 44, which is in accord with the teachings of a copending patent application Ser. No. 558,657 filed on Mar. 17, 1975 by Frank L. Townsend and myself, and a package drive roll 43 for each winding unit 38. A package support 45 for each winding unit is pivotally mounted on the beam 37 so that a package 46 supported thereby is positioned to rest upon and be driven by a respective package drive roll 43.

The spinning sub-assemblies 27 and the winding sub-assemblies 36 are handled as unitary components when they are placed upon and bolted to the lower and upper supporting surfaces 20, 19 respectively in the preferred embodiment. It will be obvious however that sub-assemblies are only convenient and not a necessity. The components comprising the sub-assemblies could be affixed in proper relation to the backbone without first being combined into sub-assemblies. More or fewer sub-assemblies could be provided and the combinations of components in and the functions of the sub-assemblies may be altered as a matter of choice.

Although a tubular backbone 15 is sufficiently rigid to permit the intermediate sections 11 to be supported solely by end sections 12, 13, it is convenient to provide a leg 47 affixed to each backbone 15 to assist in supporting the intermediate sections.

The modular intermediate sections 11 are coextensive in length with the backbone 15 and are complete in themselves aside from connections to power and vacuum sources.

It will be obvious that individual sub-assemblies and drive shafts may be shorter than the backbone upon which they are supported if several such sub-assemblies and shafts can be joined together to produce a combined length substantially equal to that of the backbone. It will also be apparent that the number of drive shafts and ducts may vary as they are combined to provide multiple functions or separated to supply single functions. Regardless of the design, the shafts and ducts serving like functions in the intermediate modular sections must be so mounted on the backbone that they will be in accurate operative alignment when adjacent backbones are joined together. Spinning and winding sub-assemblies may be supported on both sides or only one side of the backbone.

The end sections 12, 13 supply the mechanical power to the drive shafts 31, 32, 40, 41 and to an endless belt (not shown) in channel box 28, and provide a vacuum source for the ducts (backbone 15 in this embodiment). In the preferred embodiment, the end sections 12, 13 are identical, providing power and a vacuum source for the spinning and winding sub-assemblies 27, 36 on respective sides of the backbones 15. End sections 12, 13 also provide pads 49, identical in form to flanges 16, 17, for connection to respective terminal flanges 16, 17 of the string of intermediate sections 11. The pads 49, like the flanges 16, 17 must be flat and perpendicular to the backbones 15 in order to permit the sections 11, 12, 13 to be accurately aligned.

Figure 4:
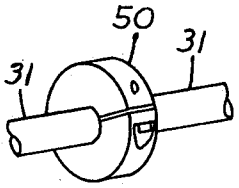
FIG. 4 is a detail of a shaft connection.

When the open end spinning machine 10 is assembled, the locating pins 21 and receiving holes 22 in adjacent flanges 16, 17 or pads 49, are aligned and the sections 11, 12 or 13 involved are moved toward each other so that the pins 21 enter holes 22 and so accurately position the sections with respect to each other. The flanges and pads are then bolted together to connect the sections into a rigid structure. The respective shafts 31, 32, 40, 41 of the adjacent sections 11 are coupled end-to-end, as by a clamp type couplings 50 shown in FIG. 4. The same type coupling can be employed to connect the respective terminal shafts 31, 32, 40, 41 to the corresponding mechanical power supplies (not shown) in the end sections 12, 13. When the backbone 15 acts as a duct, the vacuum source in the end sections 12, 13 are operatively connected to the backbone. If ducts separate from the backbone are employed, they are coupled end-to-end and to respective vacuum sources in end sections 12, 13, as by rubber or plastic tubing or by wraps of tape covering the joint. An endless belt (not shown) is inserted into each channel box 28 in driving relation to the spinning rotors (not shown) and engaged with the mechanical power supply (not shown) in an end section 12 or 13, as described in said Stahlecker patent.

The embodiment shown and described is illustrative only. Many modifications will be obvious to those skilled in the art. The scope of this invention is defined by the claims.

I claim:

1. A modular section to be inserted as a unit into an open end spinning machine, said section comprising an elongated rigid backbone, a plurality of open end spinning units, means for mounting said spinning units on the backbone at predetermined spaced spinning stations, a plurality of winding units, and means for mounting said winding units on said backbone in predetermined relation to the spinning units.

2. A section according to claim 1, the means for mounting said spinning units comprising a rigid spinning unit support for mounting a plural number of said spinning units, and means for affixing said support to the backbone.

3. A section according to claim 2, wherein said spinning unit support and the spinning units mounted on the support form a spinning sub-assembly.

4. A section according to claim 3, wherein said spinning sub-assembly additionally comprises a rotatable drive shaft coupled to each of said plural number of spinning units.

5. A section according to claim 4, wherein said drive shaft is rotatably supported on the spinning unit support.

6. A section according to claim 4, wherein the length of said drive shaft substantially equals the length of said spinning sub-assembly.

7. A section according to claim 4, wherein the length of said drive shaft substantially equals the length of said backbone.

8. A section according to claim 4, additionally comprising a coupling on an end of said drive shaft for connecting the drive shaft in end-to-end relation to a second drive shaft.

9. A section according to claim 1, the means for mounting said winding units comprising a winding unit support for mounting a plural number of said winding units, and means for affixing said support to the backbone.

10. A section according to claim 9, wherein said winding unit support and the winding units mounted on the support form a winding sub-assembly.

11. A section according to claim 10, wherein said winding sub-assembly additionally comprises a rotatable drive shaft coupled to each of said plural number of winding units.

12. A section according to claim 11, wherein said drive shaft is rotatably supported on the winding unit support.

13. A section according to claim 11, wherein the length of said drive shaft substantially equals the length of said winding sub-assembly.

14. A section according to claim 11, additionally comprising a coupling on an end of said drive shaft for connecting the drive shaft in end-to-end relation to a second drive shaft.

15. A section according to claim 1 additionally comprising connecting means at an end of said backbone.

16. A section according to claim 1 additionally comprising a flange on an end of said backbone.

17. A section according to claim 16, wherein said flange is flat and perpendicular to the longitudinal axis of said backbone.

18. A section according to claim 17 additionally comprising locating means for accurately aligning said backbone laterally in end-to-end relation to another backbone.

19. A section according to claim 2 additionally comprising a duct in parallel substantially fixed relation to the spinning unit support.

20. A section according to claim 19 additionally comprising means for connecting said duct in operative relation to a spinning chamber in each of said spinning units.

21. A section according to claim 19 additionally comprising means for connecting said duct in operative relation to a cleaning chamber in each of said spinning units.

22. A section according to claim 19, wherein the length of said duct substantially equals the length of said spinning unit support.

23. A section according to claim 19, wherein the length of said duct substantially equals the length of said backbone.

24. A section according to claim 19, wherein said duct and said backbone are one and the same, said backbone being tubular.

25. A section according to claim 19, additionally comprising means for joining said duct in operational end-to-end relation to another duct.

26. A section according to claim 1, further comprising means attached to said backbone for supporting the section.

27. An open end spinning machine comprising an end section providing mechanical power and a vacuum source for a modular intermediate section operatively connected to the end section, said intermediate section comprising an elongated rigid backbone supporting all other components of said intermediate section in predetermined fixed relations to the backbone.

28. An open end spinning machine according to claim 27 additionally comprising a second modular intermediate section, locating means for aligning the backbones of said intermediate sections in fixed lateral relation, and coupling means for retaining said backbones in abutting end-to-end relation.

29. An open end spinning machine according to claim 28 wherein each of said intermediate sections comprises a drive shaft mounted for rotation in a predetermined fixed relation parallel to the backbone, and said machine further comprises means for coupling in operative end-to-end relation the respective drive shafts in said adjacent intermediate sections.

30. An open end spinning machine according to claim 28 wherein each of said intermediate sections comprises a duct in parallel substantially fixed relation to the backbone, and said machine further comprises means for coupling in operative end-to-end relation the respective ducts in said adjacent intermediate sections.

31. An open end spinning machine according to claim 30, wherein said backbones are tubular and the backbone and duct in each intermediate section are one and the same.

* * * * *